US005899770A

United States Patent [19]

Ezawa

[11] Patent Number: 5,899,770

[45] Date of Patent: May 4, 1999

[54] MODULAR PLUG AND MODULAR JACK

[75] Inventor: Katsuya Ezawa, Tokyo, Japan

[73] Assignee: Hirose Electric Co., Ltd., Tokyo, Japan

[21] Appl. No.: 08/951,509

[22] Filed: Oct. 16, 1997

[30] Foreign Application Priority Data

Nov. 5, 1996 [JP] Japan ..... 8-292756
Nov. 5, 1996 [JP] Japan ..... 8-292757

[51] Int. Cl.[6] ..... H01R 4/24

[52] U.S. Cl. ..... 439/418; 439/676; 439/941; 439/942

[58] Field of Search ..... 439/344, 418, 439/941, 942, 676

[56] References Cited

U.S. PATENT DOCUMENTS 4,054,350 10/1977 Hardesty ..... 439/418
5,571,035 11/1996 Ferrill ..... 439/676
5,624,274 4/1997 Lin ..... 439/676
5,628,647 5/1997 Rohrbaugh et al. ..... 439/941
5,647,770 7/1997 Belopolsky ..... 439/676
5,727,962 3/1998 Caveney et al. ..... 439/344

*Primary Examiner*—Steven L. Stephan
*Assistant Examiner*—Brian J. Biggi
*Attorney, Agent, or Firm*—Kanesaka & Takeuchi

[57] ABSTRACT

A modular plug for directing a plurality of twist pairs of core wires into an opening of a modular jack (500) for electrical connection, includes a guide member (140) for separating and arranging the twist pairs for each twist pair; a housing (110) for positioning and holding each twist pair for each core wire; and a plurality of contact terminals (120), each connected to each core wire. The contact terminals are arranged such that adjacent contact terminals are not substantially overlapped each other or overlapped only in part. The modular jack includes a plurality of contact terminals (520) arranged such that adjacent contact terminals are not substantially overlapped each other.

10 Claims, 9 Drawing Sheets

MODULAR PLUG AND MODULAR JACK

BACKGROUND OF THE INVENTION

1. Field of the Invention

The present invention relates to modular plugs and modular jacks and, particularly, to a modular plug for directing a plurality of twist pairs of core wires into the opening of a modular jack for electrical connection and modular jack for use with a modular plug for electrical connection with a plurality of core wires.

2. Description of the Related Art

Modular plugs and modular jacks are used for telephone sets or local area networks. A modular plug is connected to a plurality of core wires of a cable and plugged into equipment. A modular jack is mounted on the equipment to receive the modular plug.

A guide member is provided in the modular plug to arrange the core wires of a cable. An example of the guide member is shown in Japanese patent application Kokai No. 7937/96. The guide member is made from plastic, and the core wires are arranged horizontally at regular intervals. The cable has a plurality of twist pairs, each of which consists of a pair of twisted core wires, to prevent generation of noise by the alternating magnetic fields.

A contact terminal is attached to each of the core wires arranged by the guide member to receive an electrical signal from the core wire and transmit it to the modular jack. A substantially rectangular contact terminal is disclosed by the above Japanese patent application, and a blade-like contact terminal is disclosed in Japanese patent application Kokai No. 1621756/96. These contact terminals are arranged at regular intervals such that adjacent contact terminals overlap each other in the entire area.

Also, a plurality of contact terminals are provided in the modular jack. When the modular plug is plugged into the modular jack, the contact terminals are brought into contact each other. The contact terminals of the modular jack are arranged at regular intervals such that adjacent contact terminals overlap each other.

The current running in a circuit or terminal is induced by electromagnetic or static coupling to flow in another circuit to thereby cause crosstalk. The crosstalk interferes with signal transmission in the circuit or terminal, causing noise or other problems. Accordingly, it is necessary to reduce the crosstalk.

When the core wires are arranged horizontally at regular intervals, the twist pairs are prone to electromagnetic coupling and hardly receive shielding effect. Consequently, crosstalk can occur between the twist pairs. Where the guide member is made from a plastic, the same problem takes place. Where the contact terminals are arranged such that they overlap each other, crosstalk can occur between the contact terminals.

Where adjacent contact terminals of the modular jack overlap each other, crosstalk takes place between the contact terminals. Where the contact terminals of the modular jack form pairs corresponding to the twist pairs of the modular plug, crosstalk can occur between the paris.

SUMMARY OF THE INVENTION

Accordingly, it is an object of the invention to provide a modular plug which reduces crosstalk in the use of twist pairs.

It is another object of the invention to provide a modular plug having a guide member able to solve the above problem.

It is still another object of the invention to provide a modular plug which reduces crosstalk between the contact terminals.

It is yet another object of the invention to provide a modular jack which reduces crosstalk between the contact terminals.

It is another object of the invention to provide a modular jack having capable of reducing the crosstalk between the pairs of contact terminals corresponding to twist pairs of the modular plug.

According to one aspect of the invention there is provided a modular plug for directing a plurality of twist pairs of core wires into an opening of a modular jack for electrical connection, which includes a guide member for separating and arranging the twist pairs for each twist pair; a housing for positioning and holding the each twist pair for each core wire; and a plurality of contact terminals, each connected to the each core wire.

It is preferred that the guide plate is made from metal.

It is preferred that the core wires are held in the housing such that adjacent core wires are offset vertically.

Also, according to another aspect of the invention there is provided a modular plug for directing a plurality of twist pairs of core wires into an opening of a modular jack for electrical connection, which includes a guide member for separating and arranging the twist pairs for each twist pair; a housing for positioning and holding the each twist pair for each core wire; and a plurality of contact terminals, each connected to the each core wire, the contact terminals being arranged such that adjacent contact terminals are not substantially overlapped each other.

It is preferred that the contact terminals are arranged such that adjacent contact terminals are overlapped only in part.

It is preferred that the contact terminals are arranged such that adjacent contact terminals are offset in a longitudinal direction of the core wires.

It is preferred that the contact terminals are arranged such that adjacent contact terminals are offset vertically.

According to still another aspect of the invention there is provided a modular jack for receiving a modular plug for electrical connection with a plurality of core wires, comprising a plurality of contact terminals arranged, one for each of the core wires, such that adjacent contact terminals do not substantially overlap each other.

The contact terminals have diagonal sections flexible when the modular plug is plugged and arranged such that adjacent diagonal sections do not substantially overlap each other.

The contact terminals have attaching sections arranged such that adjacent attaching sections do not overlap each other.

According to yet another aspect of the invention there is provided a modular jack for use with a modular plug having a plurality of first contact terminals connected to a plurality of twist pairs of core wires, which includes a plurality of second contact terminals forming pairs corresponding to the twist pairs and having diagonal sections flexible upon contact with the first contact terminals of the modular plug and attaching sections fixed to the modular jack, the second contact terminals arranged such that the attaching sections are distributed so as to be away from the diagonal sections

DESCRIPTION OF THE PREFERRED EMBODIMENT

Figure 1:
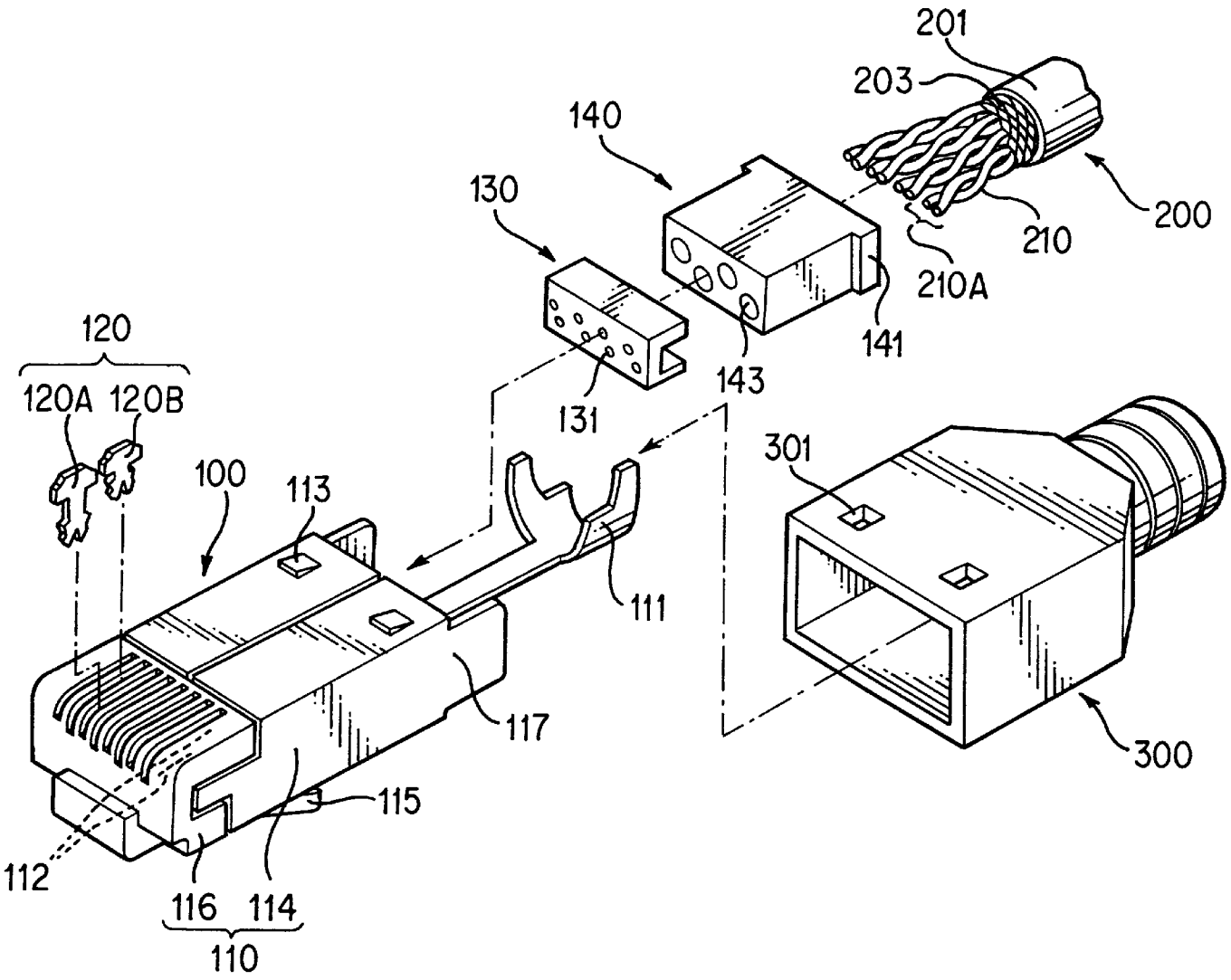
FIG. 1 is an exploded perspective view of a modular plug according to an embodiment of the invention.

In FIG. 1, a modular plug 100 includes a housing 110, an arranging member 130, a guide plate 140, a plurality of contact terminals 120 (120A, 120B), and an insulating case 300. The housing 110 includes a shield case 114 and an insulation block 116 provided at an end of the shield case 114. The shield case 114 and the insulation block 116 are made from metal and plastic, respectively.

A plurality of core wires 210 of a cable 200 are separated and arranged by the arranging member 130 and the guide plate 140 and connected to the contact terminals 120 in the housing 110. Each core wire 210 of the cable 200 is wrapped by an insulation material. A bundle of these core wires 210 are surrounded by a shield wire 203 and a sheath 201. A pair of core wires 210 are twisted to form a twist pair 210A. In this embodiment there are four twist pairs 210A. These twist pairs 210A are entangled within the cable 200.

The core wires 210 of the cable 200 are separated into twist pairs 210A and held by the guide plate 140 which is made from metal. Four through-holes 143 are provided in the guide plate 140 in a zigzag fashion. Each twist pair 210A is put through one of the through-holes 143 to provide a shield effect, thereby minimizing the crosstalk between twist pairs. Where the arranging member 130 is made from metal, the crosstalk between twist pairs is further reduced.

A pair of raised sections 141 are provided on opposite sides of the guide plate 140 to serve as stoppers within the housing 110 and enhance the shield of the housing. When the guide plate 140 is inserted in the housing 120 and a pair of tabs 117 of the shield case 110 are bent inwardly, the raised sections 141 are covered by the bent tabs 117 to enhance the shield effect of the housing 110.

The arranging member 130 separates and positions respective core wires to facilitate insertion into holes in the insulation block 116. Also, it has the same function as that of the insertion hole of the housing hereinafter described. The number of the through-holes 131 provided in the arranging member 130 is equal to that of the core wires 210 or 8 (=4×2) in this case.

Figure 2:
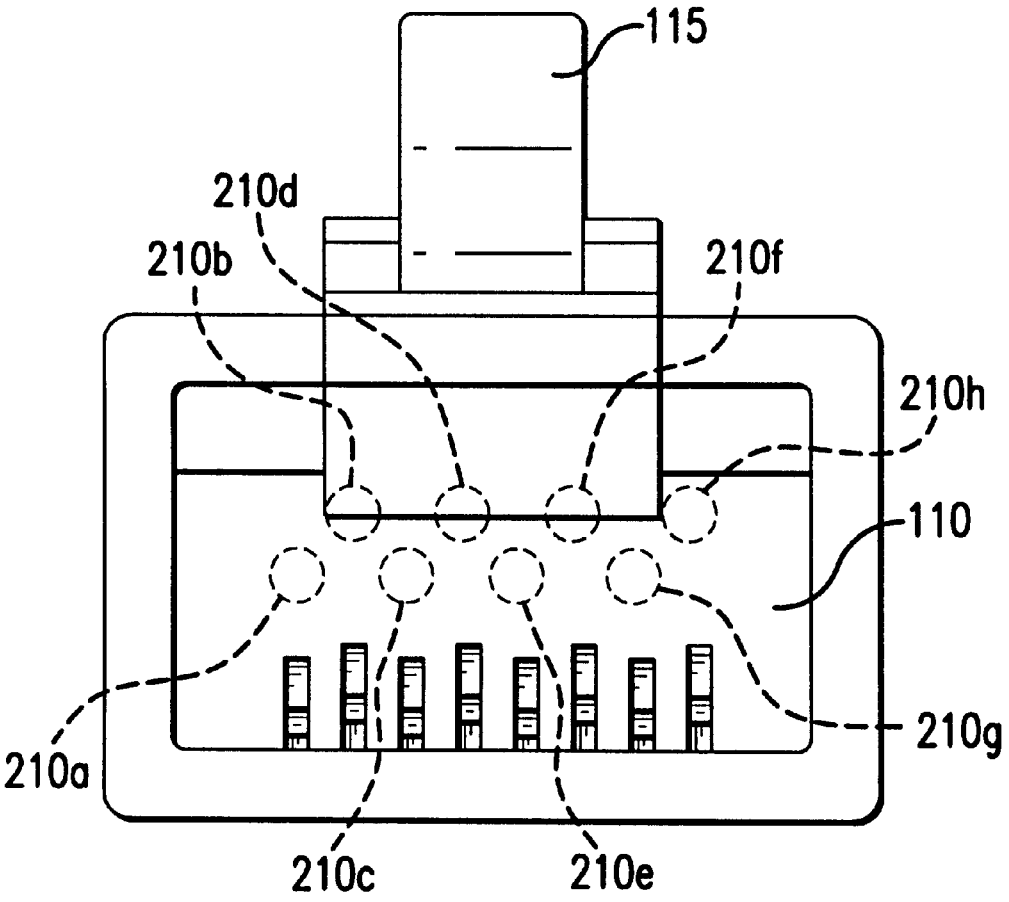
FIG. 2 is a front view of a housing of the modular plug.

The housing 110 receives the guide plate 140 and the arranging member 130 within the shield case 114 and holds the core wires 210 in the insulation block 116. Eight insertion holes (not shown) are provided in the insulation block 116 at positions corresponding to the through-holes 131 of the arranging member 130. It is noted that the insertion holes are not through-holes. FIG. 2 is a front view of the housing wherein the core wires 210*a*–210*h* in the insertion holes are shown by phantom line. The respective core wires form twist pairs 210*a* and 210*b*, 210*d* and 210*e*, 210*g* and 210*h*, and 210*c* and 210*f* to minimize the crosstalk caused by electromagnetic and/or static coupling.

The above arrangement is based on the following well-known principle. When currents in opposite phase flow in two core wires, the magnetic fluxes made by the two core wires offset each other at positions equal distances from the core wires, thus producing no effects by the magnetic fluxes. In FIG. 2, the magnetic fluxes produced by the core wires 210*a* and 210*b*, 210*d* and 210*e*, or 210*g* and 210*h* have little influence on the other pairs, and the magnetic fluxes produced by the core wires 210*c* and 210*f* have little influence on the other pairs because they are far away from each other. As a result, the crosstalk as a whole is minimized.

Figure 5:
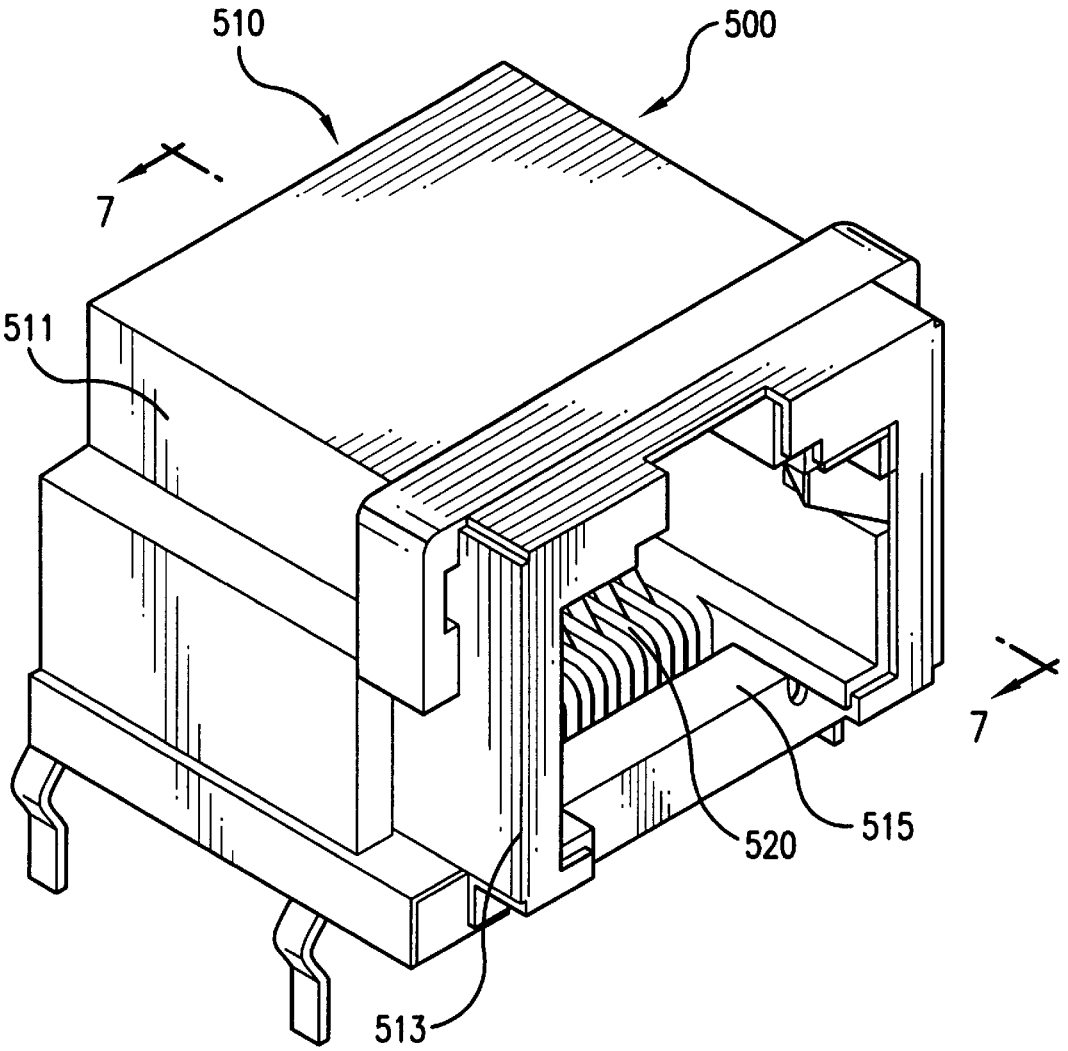
FIG. 5 is a perspective view of a modular jack according to an embodiment of the invention.

The housing 110 has a lock section 115 to secure the modular plug 100 to a modular jack 500 (FIG. 5). The lock section 115 is integrated with the insulation block 116 and extends rearwardly obliquely from the insulation block 116. The lock section 115 is made from plastic so as to be flexible. The functions of the lock section 115 will be described hereinafter. The contact terminals 120 are connected to the core wires 210*a*–210*h* fixed to the housing 110 and receive electrical signals from the core wires and transmit them to contact terminals of the jack. When the modular plug is plugged to the modular jack, these contact terminals are brought into contact with each other. The number of contact terminals 120 is equal to that of the core wires 210 or eight in this case, and each contact terminal 120 is assigned to one of the core wires 210. The contact terminals are fitted into the housing 110 from outside. Insertion grooves 112 are provided in the insulation block 116 at positions corresponding to the core wires. The contact terminals 120 are press connected to the core wires 210 through the insertion grooves 112. The tip of each contact terminal 120 is sharpened so that it pierces into the insulation of each core wire 210 and come into contact with the inner conductor.

There are two types of contact terminals; i.e., long terminals 120A having long legs and short terminals 12B having short legs. These terminals are connected to the core wires alternately. That is, in FIG. 2, long terminals 120A and short terminals 120B are connected to upper core wires 210*b*, 210*d*, 210*f* and 210*h* and lower core wires 210*a*, 210*c*, 210*e*, and 210*g*, respectively. Since the long terminals 120A extend upwardly more than the short terminals 120B, the crosstalk is further minimized.

Figure 3:
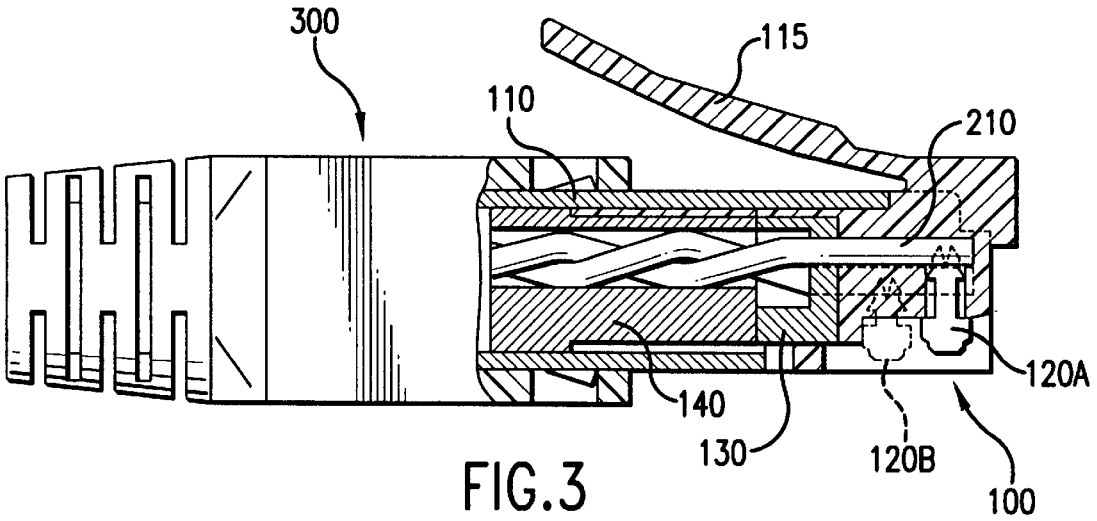
FIG. 3 is a sectional view of the modular plug.

In FIG. 3, the long and short terminals 120A and 12B have a width equal to a half of the conventional one and are arranged in a zigzag fashion so that they do not overlap each other. In other words, the long and short terminals 120A and 120B are arranged in separate rows sufficiently apart each other to avoid overlapping of the adjacent terminals to minimize the electromagnetic and/or static coupling and crosstalk. Alternatively, the width of contact terminals may remain the same as the conventional one but the contact terminals may be offset so that they do not overlap each other.

Figure 4:
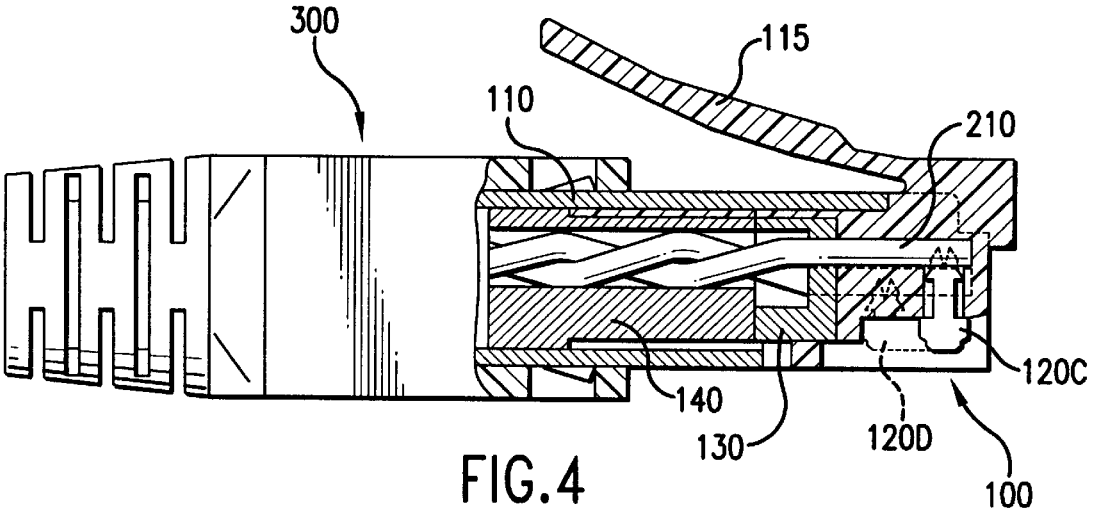
FIG. 4 is a sectional view of a modular plug according to another embodiment of the invention.

In FIG. 4, the width of only long terminals 120C is a half of the conventional one while the width of short terminals 120D remain the same as the conventional. Consequently, the long terminals 120C overlap a part of the short terminal 120D so that when the modular plug is plugged to the modular jack, the contact terminals of both the plug and the jack are brought into contact with each other at the same positions, thereby providing stable connection. In addition, the majority of the areas of the short terminals 120D does not overlap the long terminals 120C so that the crosstalk is minimized as in the FIG. 3 embodiment. Alternatively, the long terminals may be as wide as the conventional one as far as they are arranged to not overlap the short terminals. Also, only the short terminals may be made narrow.

The modular plug 100 is assembled as follows. First of all, the cable 200 is inserted into the insulating case 300 through an opening at the rear side. At this point, the insulating case 300 is movable along the cable 200. Then, the core wires 210 are arranged and held by the guide plate 140 and the arranging member 130, which are inserted into and secured in the shield case 114 such that the respective core wires 210 are held in the insertion holes in the insulation block 116. Then, retaining tabs 111 of the shield case 114 are crimped onto the cable 200. Then, the contact terminals 120 are fitted into the housing 110 into the core wires 210. Finally, the insulating case 300 is moved along the cable 200 to cover the rear portion of the housing 110. This completes the assembling of the modular plug. In order to secure the insulating case 300 to the housing 110, a pair of engaging projections 113 and a pair of engaging holes 301 are provided on the shield case 114 and in the insulating case 30, respectively. When the housing 110 is inserted into the insulating case 300 to a predetermined extent, the engaging projections 113 engage the engaging holes 301 to secure the housing 110 to the insulating case 300.

Figure 6:
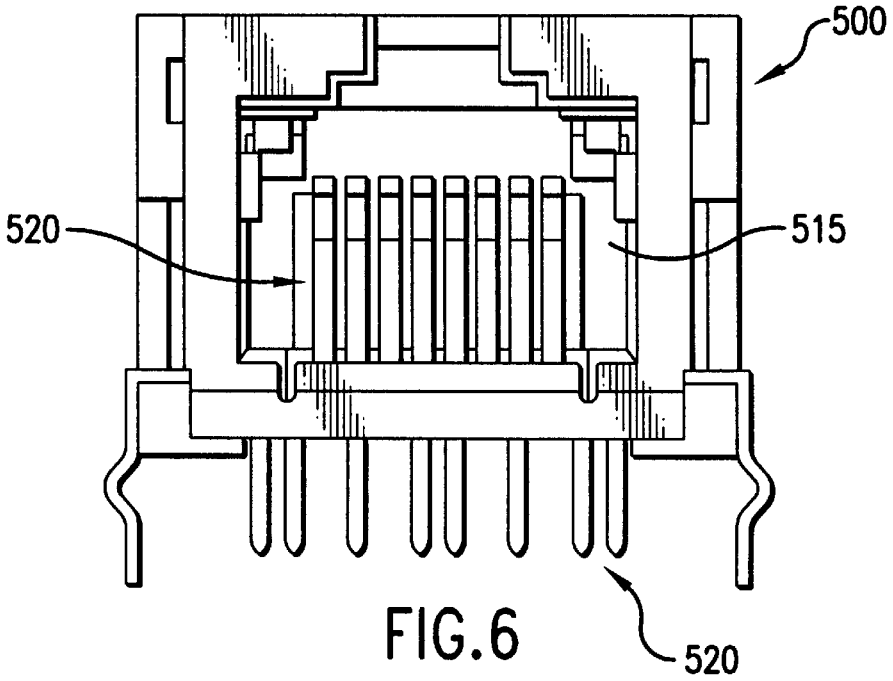
FIG. 6 is a front view of the modular jack.
Figure 7:
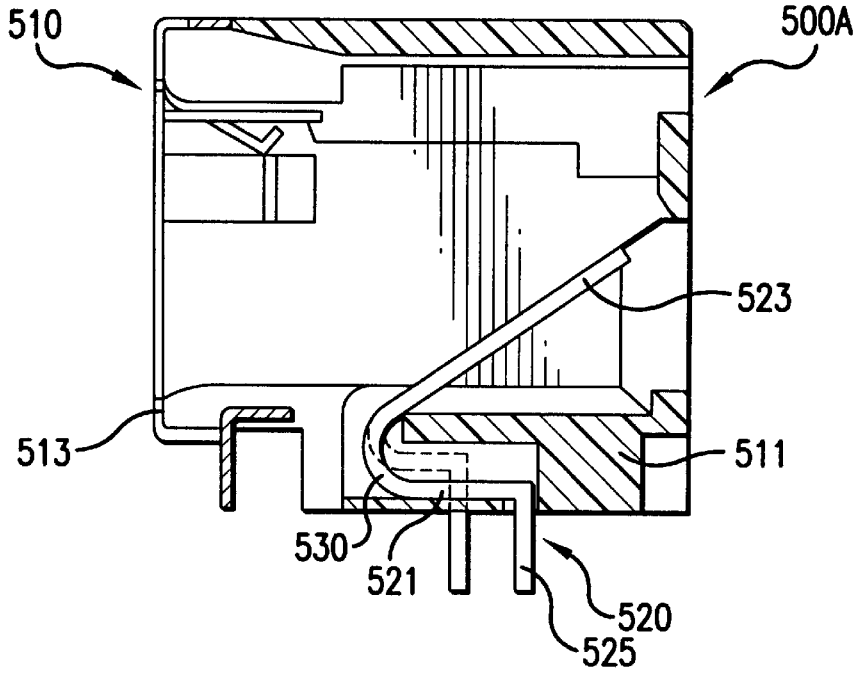
FIG. 7 is a sectional view taken from line 7—7 of FIG. 5.
Figure 8:
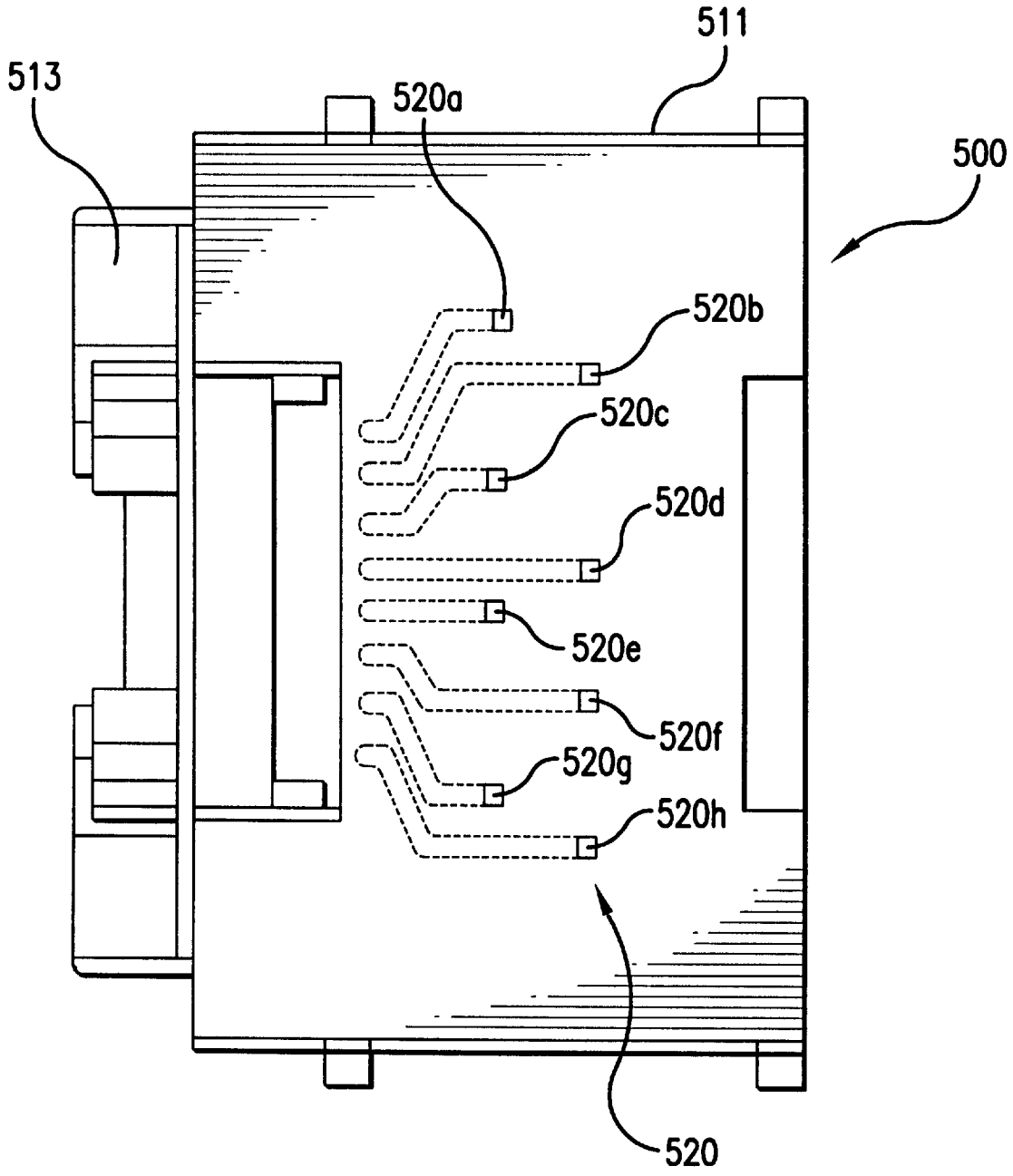
FIG. 8 is a bottom view of the modular jack.

The modular jack will be described with reference to the accompanying drawings, wherein FIG. 5 is a perspective view of the modular jack, FIG. 6 is a front view of the modular jack, FIG. 7 is a sectional view taken along line 7—7 of FIG. 5, and FIG. 8 is a bottom view of the modular jack. The modular plugs in FIGS. 3 and 4 are plugged to the modular jack 500 in FIG. 5.

The modular jack 500 includes a housing 510 and a plurality of contact terminals 520. The housing 510 includes a housing body 511 and an arranging block such as a shield case 513. The arranging block is assembled in the housing body 511 before the contact terminals 520 are fixed. In this modular jack 500, the housing 510 is made integral, and the contact terminals 520 are fitted into the housing 510.

An opening 515 is provided at the front end of the modular jack 500 to receive the modular plug 100. The opening 515 has a complemental shape of the front portion of the modular plug 100. When the modular plug 100 is plugged into the modular jack 500 to a predetermined extent, it is latched to the modular jack 500 by the lock section 115 of the modular plug 100. The lock section 115 has a raised section while the modular jack 500 has a protruded section extending downwardly. When the modular plug 100 is plugged into the modular jack 500 to the predetermined extent, the raised section of the modular plug 100 engages the downwardly protruded section of the modular jack 500 to move downwardly the lock section 115 of the modular plug 100. As the modular plug 100 is plugged into the modular jack 500, the raised section (lock section) is moved downwardly. When the raised section passes the protruded section, the lock section of the modular plug 100 snaps to secure the modular plug 100 to the modular jack 500. By pulling the modular plug 100 while depressing the lock section 115, it is possible to remove the modular plug 100 from the modular jack 500.

The contact terminals 520 of the modular jack 500 are arranged in the modular jack 500 at a predetermined distance from the opening 515. The number of the contact terminals 520 is 8 corresponding to the number of the contact terminals 120. As best shown in FIG. 7, the contact terminals 520 have a attaching section 521, an fixing section 525, and a diagonal section 523. The attaching sections 521 are used to secure the contact terminals 520 to the modular jack 500 such that the adjacent attaching sections 521 are vertically offset from each other to minimize the crosstalk.

The fixing sections 525 are used for connection to a circuit board. The fixing sections 525 project from the modular jack 500 and soldered to circuit traces when the modular jack 500 is mounted on the circuit board. The diagonal sections 523 extend diagonally upwardly from the attaching sections 521 within the modular jack 500 and are vertically flexible. When the modular plug 100 is plugged into the modular jack 500, the contact terminals 120 of the modular plug 100 are brought into contact with the diagonal sections 523 of the contact terminals 520. As the modular plug 100 is further pushed into the modular jack 500, the contact terminals 120 flex downwardly the diagonal sections 523 to make electrical connection between the contact terminals 120 and 520. The amount of flexure of the diagonal sections 523 depends on the arrangement and configuration of the contact terminals 120.

Where the modular plug 100 of FIG. 3 is plugged in, the long terminals 120A engage the diagonal sections 523 earlier than the short terminals 120B which are arranged more rearwardly in the modular plug 100 than the long terminals 120A. Consequently, the diagonal sections 523 engaged with the long terminals 120A are flexed more than those of the short terminals 120B so that the adjacent diagonal sections 523 are offset each other. This offset also minimizes the crosstalk. The amount of offset is reduced by the fact that the long terminals 120A are positioned slightly above the short terminals 120B but still is sufficiently large to produce the minimizing effect. Where the modular plug of FIG. 4 is plugged in, the long and short terminals 120C and 120D engage the diagonal sections 523 at the same positions so that the amount of flexure of the diagonal sections 523 is the same.

FIG. 8 shows the shape of the attaching sections 521 and the arrangement of the fixing sections 525. The respective contact terminals 520*a*–520*h* form pairs 520*a* and 520*b*, 520*d* and 520*e*, 520*g* and 520*h*, and 520*c* and 520*f* corresponding to the respective core wires of FIG. 2. All of the attaching sections except for 520*d* and 520*e* are distributed toward the outside from the central part of the modular jack. The father the diagonal sections are positioned from the central part, the larger the degrees with which the diagonal sections are away from the central part. The distances between the attaching sections 520*a* and 520*b*, 520*d* and 520*e*, and 520*g* and 520*h* are equal. The attaching sections 520*c* and 520*f* are away from the central part in opposite directions. In addition to such lateral distribution, the respective attaching sections are distributed vertically, too. The vertical distributions are equal between the attaching sections 520*a*, 520*c*, 520*e*, and 520*g*, and 520*b*, 520*d*, 520*f*, and 520*h*. The latter is greater than the former in distribution degrees. Depending on the configuration of the attaching sections 521, the fixing sections 525 are arranged so as to laterally form pairs 520*a* and 520*b*, 520*d* and 520*e*, and 520*g* and 520*h* and vertically are offset. In this way, the distances between the pairs in attaching and fixing sections 521 and 525 are increased to minimize the crosstalk caused by the electromagnetic and/or static coupling between the pairs. The attaching sections 520*c* and 520*f* are far away from the other attaching sections so that the crosstalk with the other attaching sections is minimized.

Figure 9:
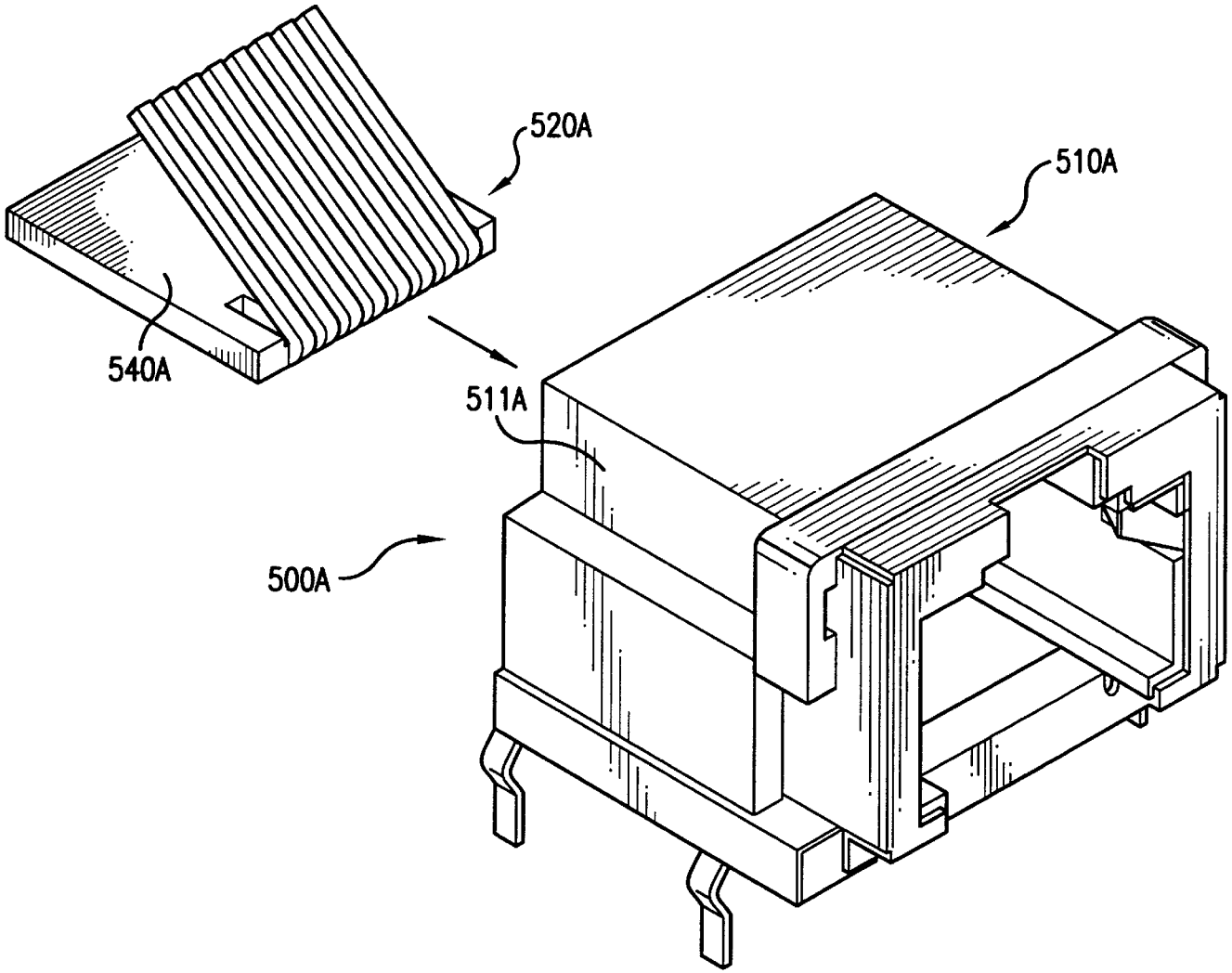
FIG. 9 is a perspective view of a modular jack according to another embodiment of the invention.

FIG. 9 shows another type of modular jack 500A which is of a two-piece construction and includes a housing 510A and a cover 540A. The contact terminals 520A are made as a unit so that the attaching sections of the contact terminals are covered by a single cover 540A. The contact terminals 520A are assembled into the housing 511A after the arranging block is attached. Unlike those of FIG. 5, the fixing sections of the contact terminals 520A are separated from the contact terminals, but the other parts are the same as those of FIG. 5. The modular jack may be conventional for use with the modular plug according to the invention.

Figure 10:
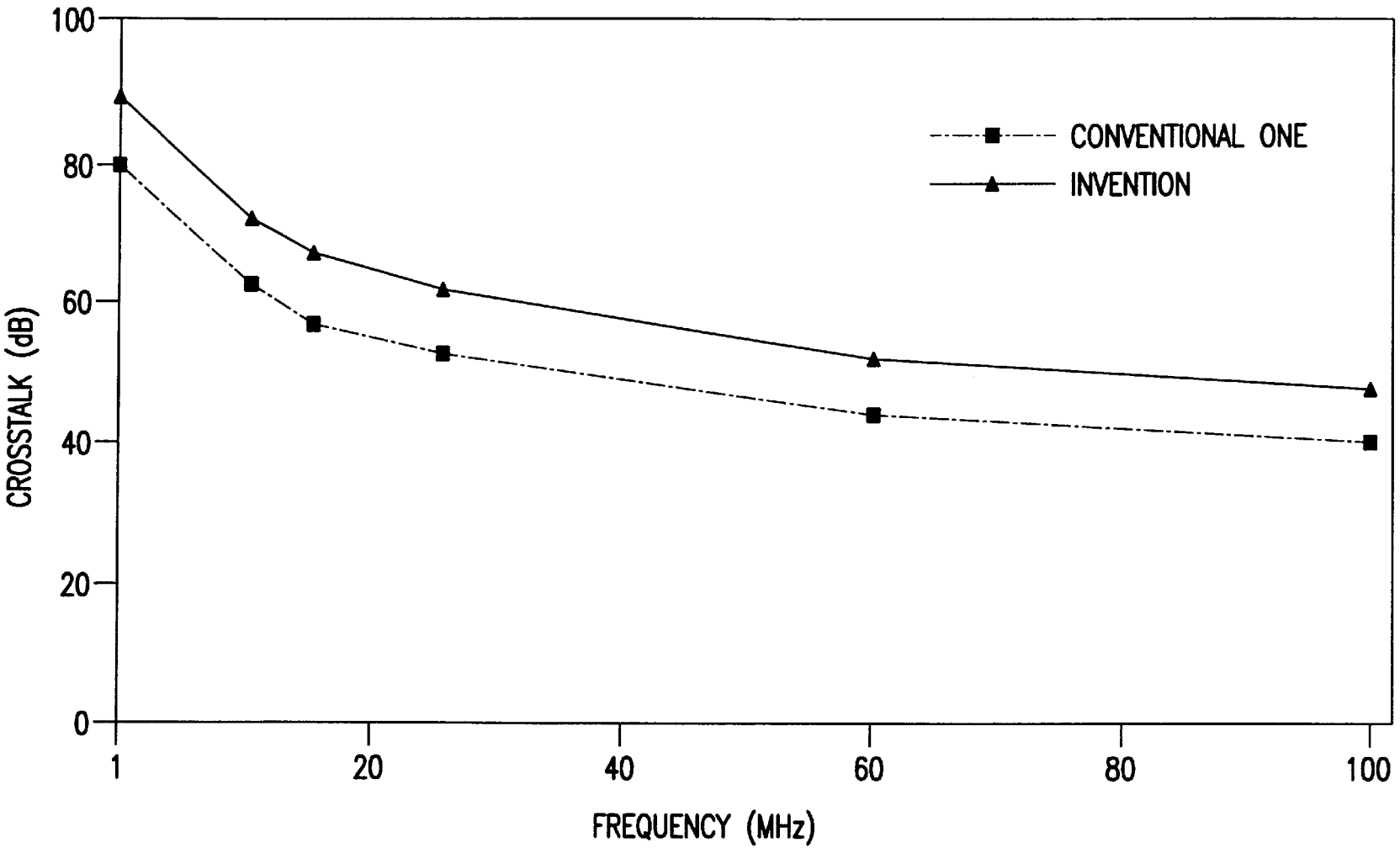
FIG. 10 is a graph of crosstalk versus frequency for the modular plug.
Figure 11:
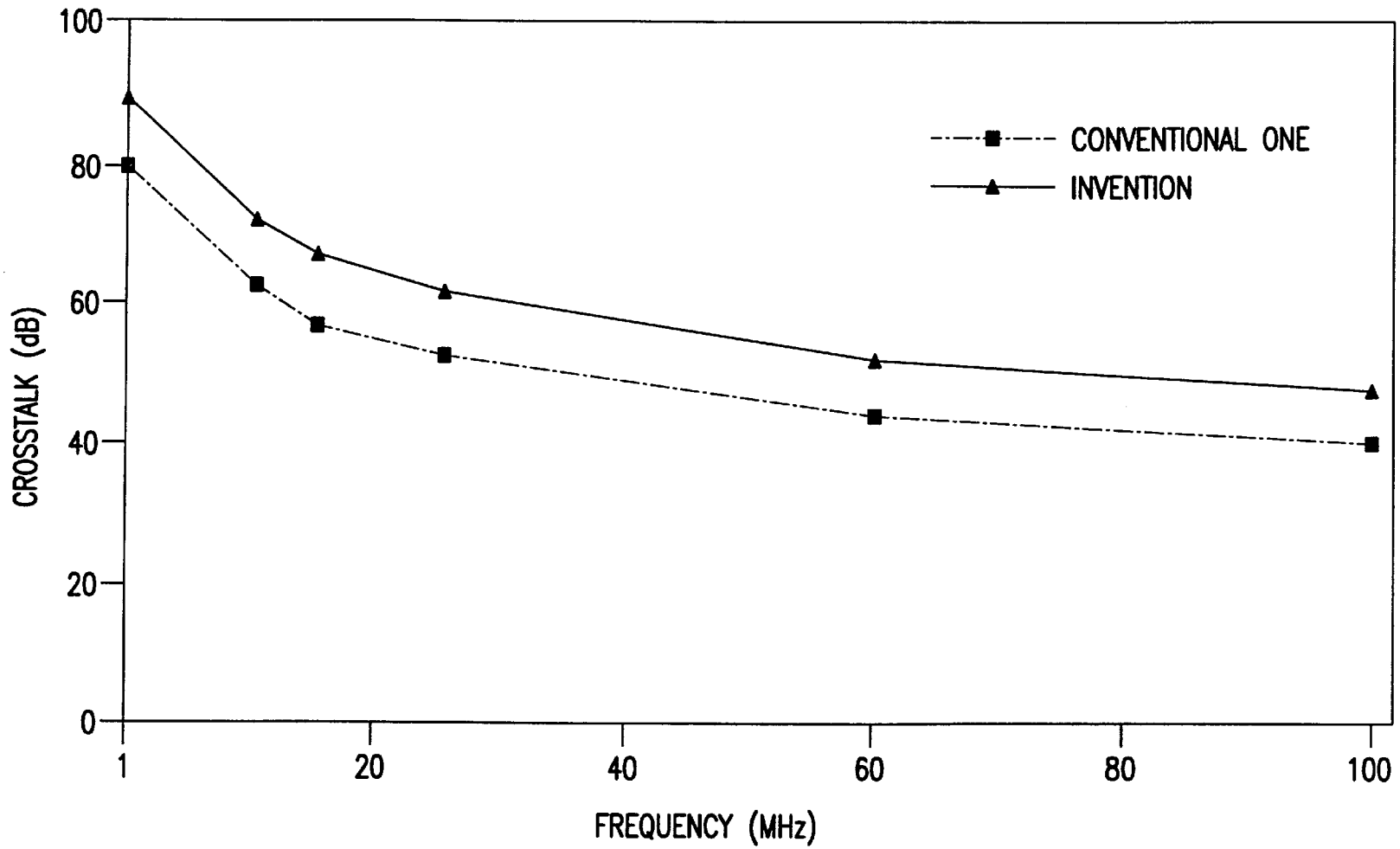
FIG. 11 is a graph of crosstalk versus frequency for the modular jack.

FIGS. 10 and 11 show how much the modular plug and modular jack according to the invention reduce the crosstalk in comparison with the conventional ones. The horizontal and vertical axes represent frequency (MHz) and crosstalk (dB) respectively. From the graphs it is evident that the modular plug and the modular jack according to the invention raised the crosstalk approximately 10 dB.

The number of twist pairs, the numbers of through-holes in the guide plate and arranging member, and the number of insertion holes in the housing, and the number of contact terminals may vary.

As described above, according to the invention, a plurality of twist pairs are arranged and held in the modular plug for each pair by the guide plate so that the crosstalk is minimized.

The guide plate is made from metal so that the crosstalk is further minimized.

The contact terminals are arranged so as to not overlap each other or minimize the overlap, thereby reducing the crosstalk between the contact terminals.

The crosstalk between the contact terminals of the modular jack is also minimized.

Where the contact terminals form pairs, the crosstalk between the pairs is also reduced.

What is claimed is:

1. A modular plug for directing a plurality of twist pairs of core wires into an opening of a modular jack for electrical connection, comprising:

a guide member for separating and arranging said twist pairs for each twist pair to thereby minimize crosstalk;

an arranging member for separating and positioning said each twist pair for each core wire; and a plurality of contact terminals, each connected to said each core wire.

2. A modular plug according to claim 1, wherein said guide member is made from metal to thereby further minimize crosstalk.

3. A modular plug according to claim 1, wherein said core wires are held in said arranging member such that adjacent core wires are offset vertically.

4. A modular plug for directing a plurality of twist pairs of core wires into an opening of a modular jack for electrical connection, comprising:

a guide member for separating and arranging said twist pairs for each twist pair;

an arranging member for separating and positioning said each twist pair for each core wire; and a plurality of contact terminals, each connected to said each core wire, said contact terminals being arranged such that adjacent contact terminals do not substantially overlap each other.

5. A modular plug according to claim 4, wherein said contact terminals are arranged such that adjacent contact terminals are overlapped only in part.

6. A modular plug according to claim 5, wherein said contact terminals are arranged such that adjacent contact terminals are offset in a longitudinal direction of said core wires.

7. A modular plug according to claim 5, wherein said contact terminals are arranged such that adjacent contact terminals are offset vertically.

8. A modular plug according to claim 4, wherein said contact terminals are arranged such that adjacent contact terminals are offset in a longitudinal direction of said core wires.

9. A modular plug according to claim 4, wherein said contact terminals are arranged such that adjacent contact terminals are offset vertically.

10. A modular plug for directing a plurality of twist pairs of core wires into an opening of a modular jack for electrical connection, comprising:

a guide member having a plurality of first through-holes to allow said twist pairs to go through said first through-holes for separating said twist pairs for each twist pair;

an arranging member having a plurality of second through-holes to allow said core wires to go through said second through-holes for separating said each twist pair for each core wire; and a plurality of contact terminals, each connected to said each core wire.

* * * * *